United States Patent [19]

Johnson et al.

[11] Patent Number: 4,655,353

[45] Date of Patent: Apr. 7, 1987

[54] KNOCK-DOWN MERCHANDISE DISPLAY FIXTURE

[75] Inventors: John A. Johnson; Edward O. Gandolf, both of Strongsville; Ronald M. Preksta, Fairview Park, all of Ohio

[73] Assignee: American Greetings Corporation, Cleveland, Ohio

[21] Appl. No.: 678,289

[22] Filed: Dec. 5, 1984

[51] Int. Cl.[4] ..... A47B 47/00

[52] U.S. Cl. ..... 211/189; 211/208; 211/183

[58] Field of Search ..... 211/189, 190, 192, 175, 211/207, 208, 182, 183, 128; 248/188.5, 333; 403/105, 107

[56] References Cited

U.S. PATENT DOCUMENTS

| | | | |
|---|---|---|---|
| 499,671 | 6/1893 | Gard et al. | 248/188.5 |
| 561,880 | 6/1896 | Fuerstenberg . | |
| 1,253,511 | 1/1918 | Moler . | |
| 1,412,181 | 4/1922 | Hyde . | |
| 2,400,162 | 5/1946 | Mulligan . | |
| 2,467,842 | 4/1949 | Marx . | |
| 2,483,395 | 10/1949 | Benson . | |
| 2,747,824 | 5/1956 | Darnell, Jr. . | |
| 2,892,647 | 6/1959 | O'Neill . | |
| 3,161,395 | 12/1964 | Carter . | |
| 3,164,260 | 1/1965 | Seemann . | |
| 3,199,464 | 8/1965 | Shook . | |
| 3,200,961 | 8/1965 | Kolster et al. . | |
| 3,291,319 | 12/1966 | Novales et al. . | |
| 3,601,432 | 8/1971 | Fenwick . | |
| 3,667,826 | 6/1972 | Wood et al. . | |
| 3,821,538 | 6/1974 | Jonathan et al. . | |
| 3,838,266 | 9/1974 | Jonathan . | |
| 3,860,350 | 1/1975 | Rogers . | |
| 3,865,248 | 2/1975 | Donovan et al. . | |
| 3,886,348 | 5/1975 | Jonathan et al. . | |
| 3,892,450 | 7/1975 | Kolster et al. . | |
| 3,898,939 | 8/1975 | Grachten . | |
| 3,963,913 | 6/1976 | Donovan et al. . | |
| 4,135,835 | 1/1979 | Kitchen et al. . | |
| 4,181,230 | 1/1980 | Acuff . | |
| 4,269,422 | 5/1981 | Biggs . | |
| 4,380,298 | 4/1983 | Harig . | |
| 4,392,692 | 7/1983 | Vogel . | |
| 4,460,097 | 7/1984 | Darwell et al. . | |

*Primary Examiner*—Ramon S. Britts
*Assistant Examiner*—Sarah A. Lechok Eley
*Attorney, Agent, or Firm*—Baldwin, Egan & Fetzer

[57] ABSTRACT

A fabricated knock-down merchandise display fixture which includes telescopic, extendible and retractable standard sections for increasing and decreasing the height of the fixture, and including a two piece gravity actuated latch unit mounted on the standards for holding the extendible standard section in selected position. The latch unit is automatically deactivated to permit ready extension of the extendible standard section by merely lifting up on the extendible section to increase the height of the fixture standard and upon release of the extendible section from upward movement, the latch unit is automatically reactivated to hold the extendible section of the standard in its newly extended position. Abutment structure is provided on the standards for limiting the telescopic movement thereof and for guiding the lengthwise movement of the extendible section. The novel features of the fixture are adapted for use with a considerable variety of different fixture arrangements for use in displaying products, with the display fixtures being readily assembled and disassembled using unskilled labor and a minimum of tools, time and effort.

29 Claims, 31 Drawing Figures

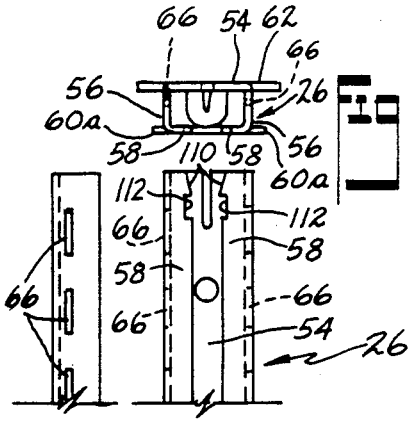
Fig 21
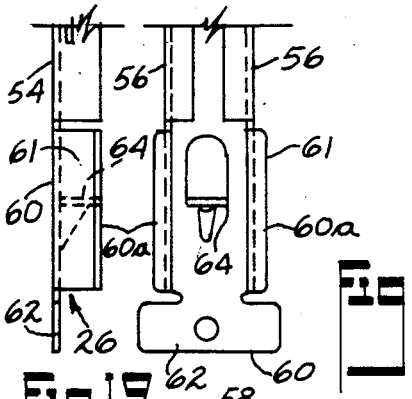
Fig 18
Fig 19
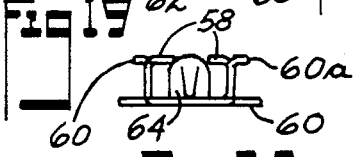
Fig 20
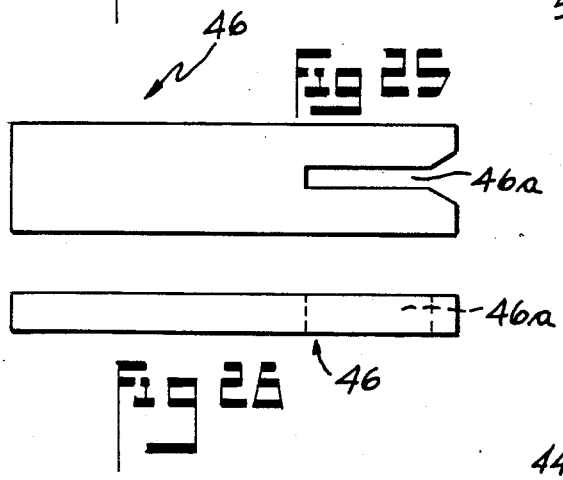
Fig 25
Fig 26
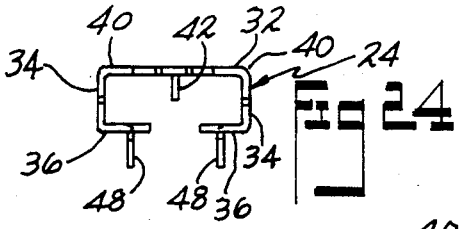
Fig 24
Fig 23
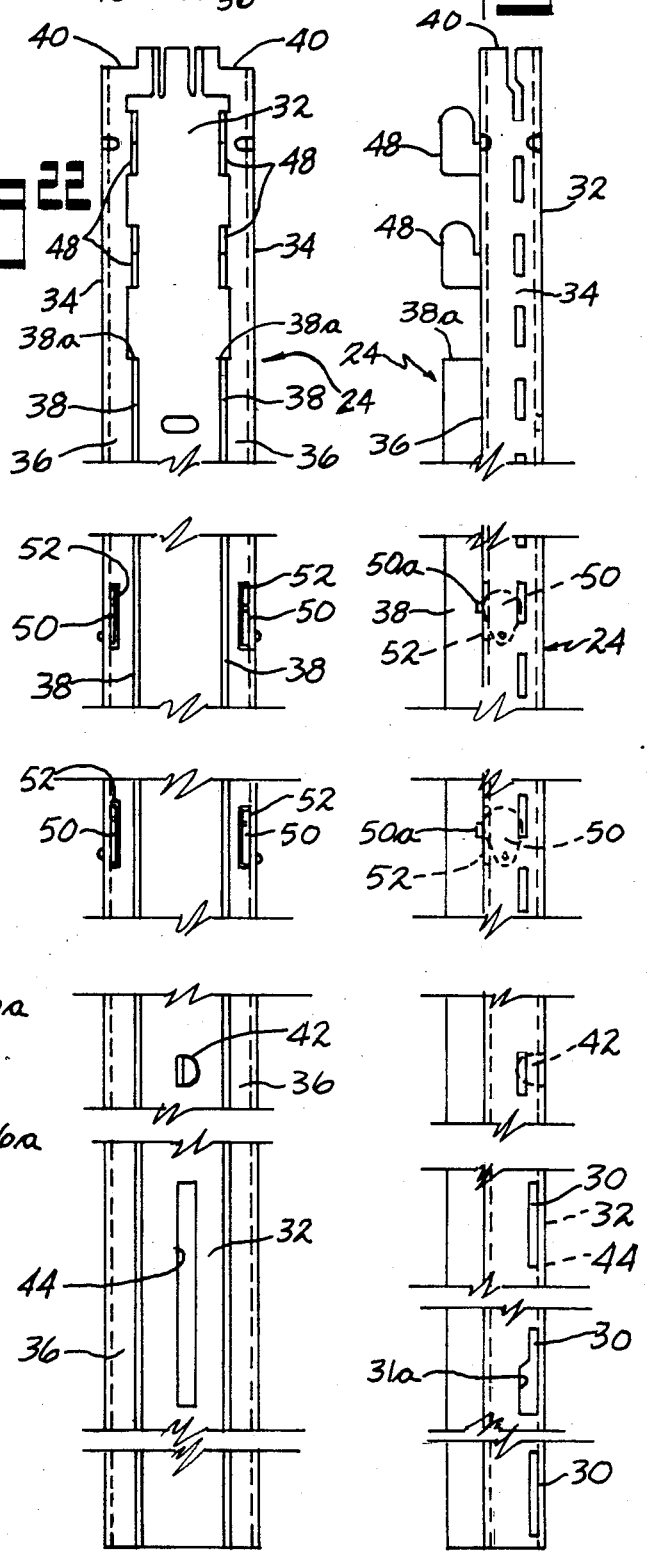
Fig 22

KNOCK-DOWN MERCHANDISE DISPLAY FIXTURE

The present invention relates in general to fabricated display fixtures or racks for displaying products and which include a base and upright standards mounted on the base for forming a back for the fixture, and more particularly a display rack for displaying products or merchandise such as for instance greeting cards, ribbon, wrapping paper and the like, which has telescopically extendible and retractable standards for forming a variable height back for the fixture, with a two-piece gravity latch unit mounted on and coacting with the standards, and which includes means for automatically causing deactivation of the latch unit to permit the extension of the extendible section of the standard relative to the primary section of the standard by merely lifting upwardly on the extendible section, and upon release of the extendible section from upward movement, causing the latch unit to be automatically reactivated to hold or latch the extendible section of the standard in its newly extended position. Various other novel features for the telescopic standard structure are also disclosed.

BACKGROUND OF THE INVENTION

Fabricated display units which may be readily assembled and disassembled are known in the prior art; it is also known in the prior art to provide an extendible and retractable standard for a merchandise display unit for changing the height of the display unit.

U.S. Pat. No. 4,460,097 issued July 17, 1984 to James P. Darnell et al and entitled Adjustable Store Fixture System discloses an adjustable height store fixture system which utilizes a deactivatable latch for providing for extension of the telescopic standards of the fixture. However, when the latch has been deactuated by lifting up on the extendible section of the standard, it has to be pushed inwardly manually by a workman in order to reactivate it to hold the extendible standard section in its newly adjusted position. The present two-piece gravity latch arrangement for the display fixture of the invention automatically reactivates itself to hold the extendible standard section in its newly adjusted position upon termination of upward movement of the extendible section of the standard. Other adjustable height prior art fixtures have various other shortcomings as compared to the present arrangement, such as for instance being more complex, and/or being more expensive to manufacture and to assemble and disassemble.

SUMMARY OF THE INVENTION

The present invention provides an improved fabricated knock-down merchandise display unit or fixture which is adapted to be readily assembled for use in displaying merchandise, and which may be readily knocked down or disassembled, and which includes extendible and retractable upright telescopic standards for forming the back of the display fixture, and wherein a novel two-piece gravity latch unit is provided for holding the extendible section of the standard in selected position relative to the primary section of the standard, and which includes means operable to automatically deactivate the latch unit to permit extension of the extendible section of the standard relative to the primary section of the standard, by lifting upwardly on the extendible section, and upon release of the extendible standard section from upward movement, causing the latch unit to be automatically reactivated, to hold the extendible section of the standard in its newly extended position. Other novel features for the telescopic standard including means for limiting the lengthwise movement of the extendible section relative to the primary section, and for guiding such movement, are also disclosed.

Accordingly, an object of the invention is to provide a merchandise display fixture which is of fabricated construction and which can be readily assembled and disassembled using relatively unskilled labor and a minimum of tools, and which is useable in a plurality of different height and environmental fixture arrangements, thus conveniently enabling the display of greater or lesser amounts of merchandise accommodated to space and use requirements.

Another object of the invention is to provide a merchandise display fixture or stand of the latter mentioned type which includes a two-piece gravity latch unit coacting between the primary and the extendible sections of the uprights forming the back of the fixture, so as to hold the extendible section in selected position relative to the primary section, and wherein the latch unit includes means for causing automatic deactivation to permit selective extension of the extendible section of the standard relative to the primary section by merely lifting upwardly on the extendible section of the standard, and for causing automatic reactivation of the latch unit upon release of the extendible section from upward movement, to hold the extendible section in extended condition, thus facilitating the adjustment of the fixture for different height environments or requirements.

A still further object of the invention is to provide a merchandise display fixture or stand wherein the extendible and retractable uprights are adapted for cantilevered mounting on a base, and wherein the primary standard sections include lengthwise extending webs for mounting a back panel between the uprights to form the back of the fixture, and wherein movable tab means are provided on the primary standard sections for removably retaining the back panel in place relative to the standards and the associated webs.

Another object of the invention is to provide a merchandise display fixture or cabinet of the latter type wherein the extendible and retractable standards for forming the back of the fixture include stop means for limiting the lengthwise movement of the extendible section.

A still further object of the invention is to provide a novel two-piece gravity latch unit for use in a merchandise display fixture having telescopically extendible standards, wherein the latch unit is automatically deactivated to permit extension of the extendible standard section relative to the primary section of the standard, by merely lifting upwardly on the extendible section, and which is automatically reactivated upon termination of upward movement of the extendible section, thereby expediting the adjustment of the display fixture to different height situations.

A still further object of the invention is to provide a novel standard construction for use in merchandise display fixtures or cabinets for expeditiously providing for the extension and retraction of the telescopic extendible section of the standard relative to the primary section of the standard.

Other objects and advantages of the invention will be apparent from the following description taken in conjunction with the accompanying drawings wherein:

Figures 1, 2, 3, 4, 5, 6:
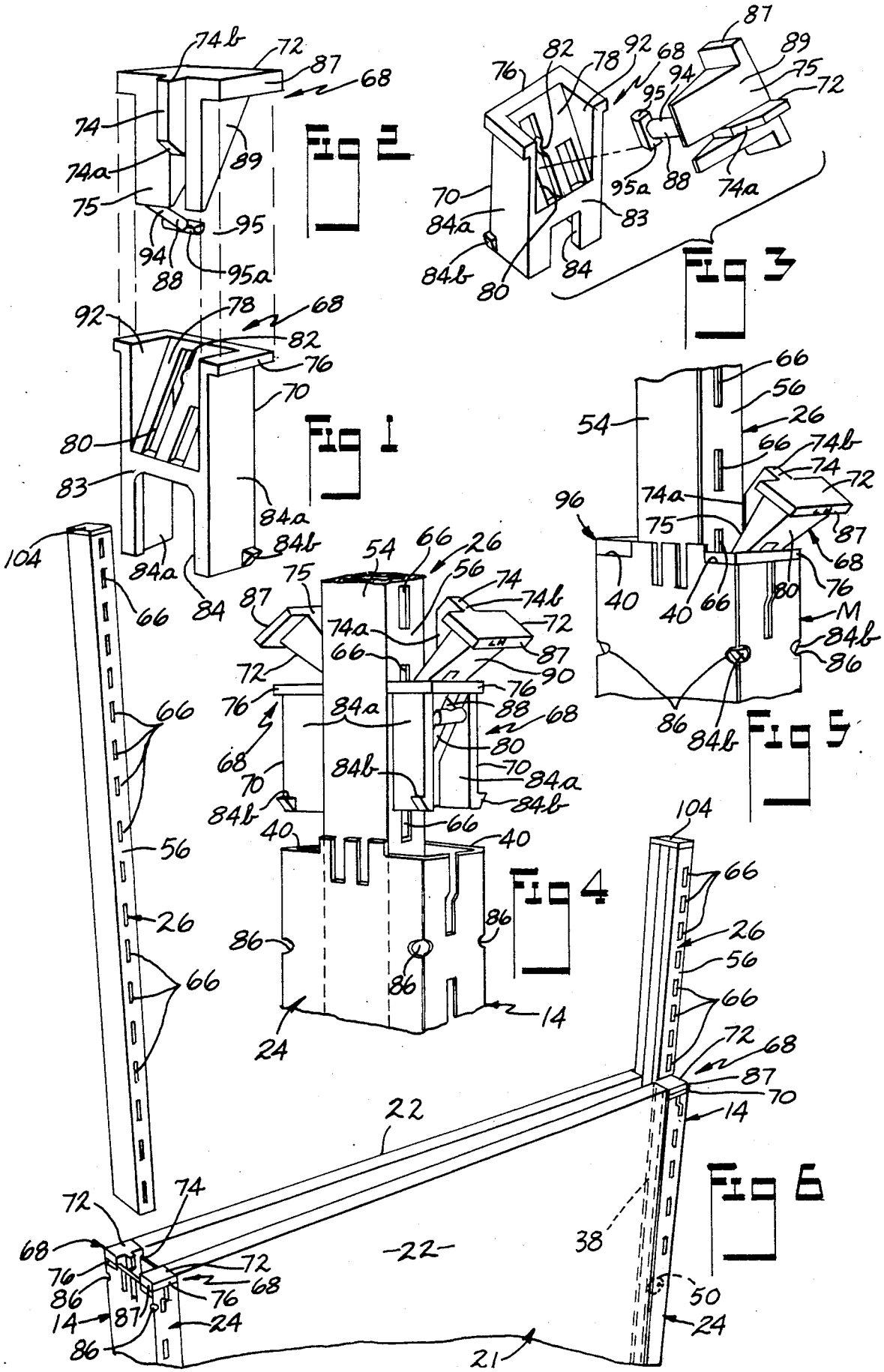
FIG. 1 is an enlarged perspective view of the holder clip portion of the gravity latch unit which is adapted for holding the extendible standard in selected extended position relative to the primary section of the standard in a merchandise display fixture.
FIG. 2 is an enlarged perspective view of the locking clip portion of the latch unit which is adapted for movable coaction with the holder clip portion when in mounted condition thereon.
FIG. 3 is an enlarged perspective illustration of the locking flip portion in a rotated position for assembly with the holding clip portion of the latch unit.
FIG. 4 is a generally exploded fragmentary view showing one of the gravity latch units disposed on either side of the extendible section of the standard, with the locking clip portion of each of the latch units being shown in completely deactivated position, and with the holding clip portions of the latch units having been moved upwardly out of their normal mounted position on the upper end of the non-extendible or primary section of the standard.
FIG. 5 is a fragmentary perspective illustration of one of the gravity latch units as mounted on the primary section of a standard, with the locking clip portion of the latch unit having been moved upwardly to completely deactivated condition and tipped out of coaction with the extendible standard section, for permitting unobstructed adjustment of the extendible standard section relative to the primary standard section.
FIG. 6 is a fragmentary illustration of a pair of spaced telescopic standards forming the back of a merchandising fixture or cabinet, and illustrating the two-piece gravity latch units coacting with the respective extendible standard section for positioning the latter in selected extended position relative to the associated primary section of each standard.
Figure 9:
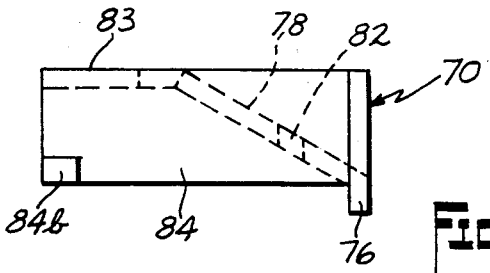
Figure 7:
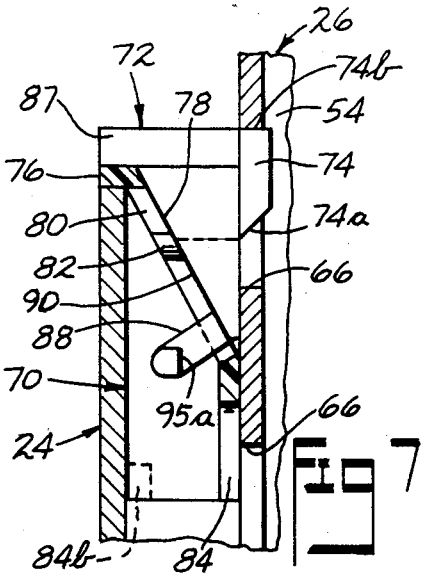
FIG. 7 is a fragmentary, vertical sectional view of one of the latch units coacting with a confronting one of the slots or openings in the extendible standard section to hold the latter in selected telescoped position with respect to the coacting primary standard section.
Figure 8:
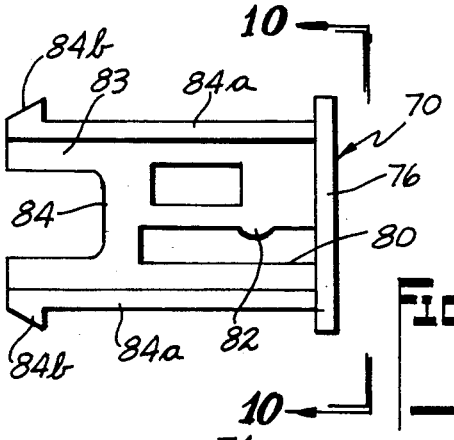
Figure 10:
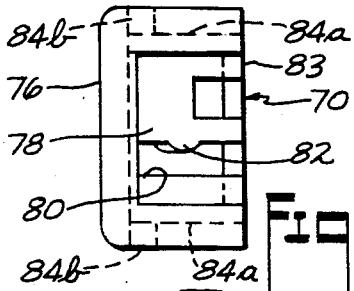
Figure 11:
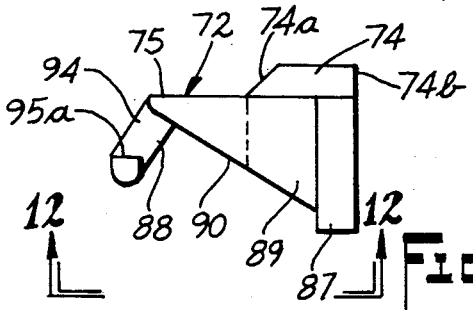
Figure 12:
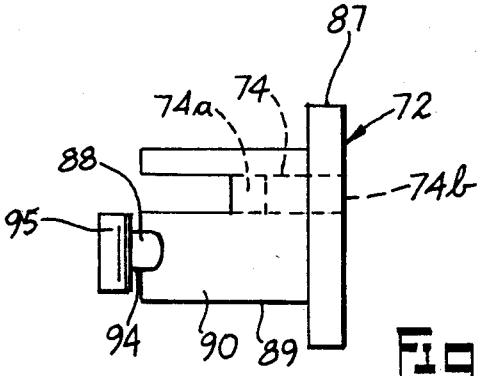
Figure 13:
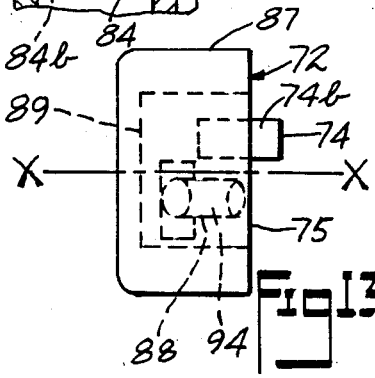
Figure 14:
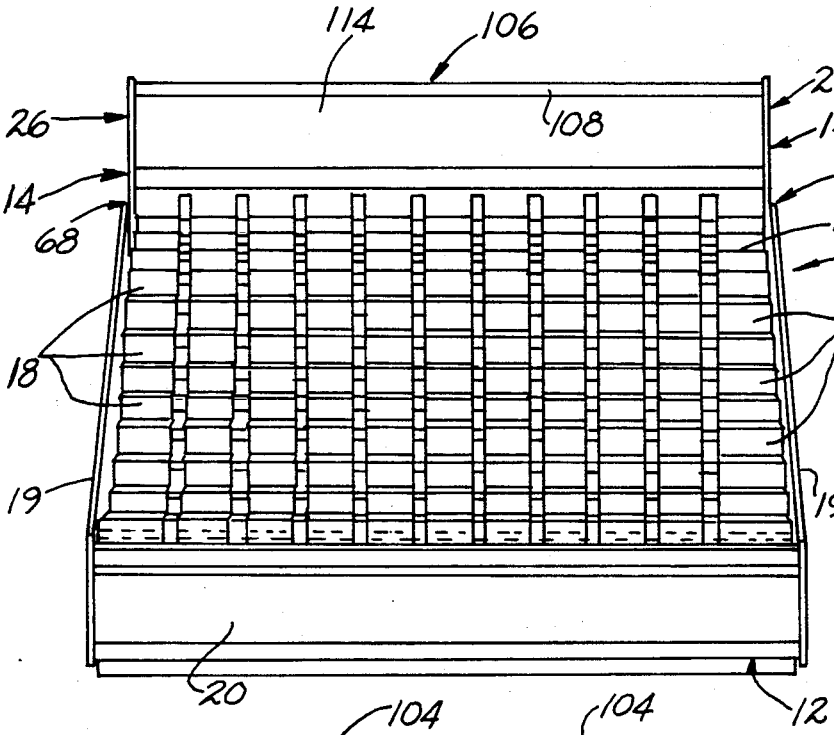
Figure 15:
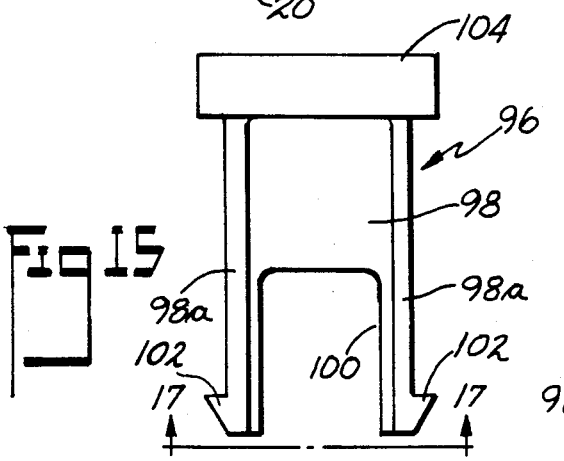
Figure 16:
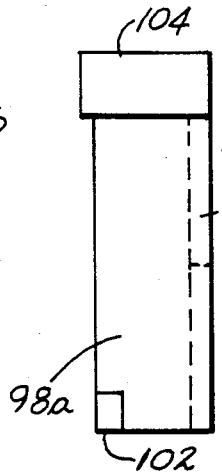
Figure 17:
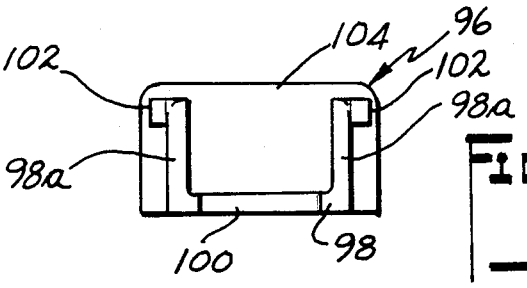
Figure 27:
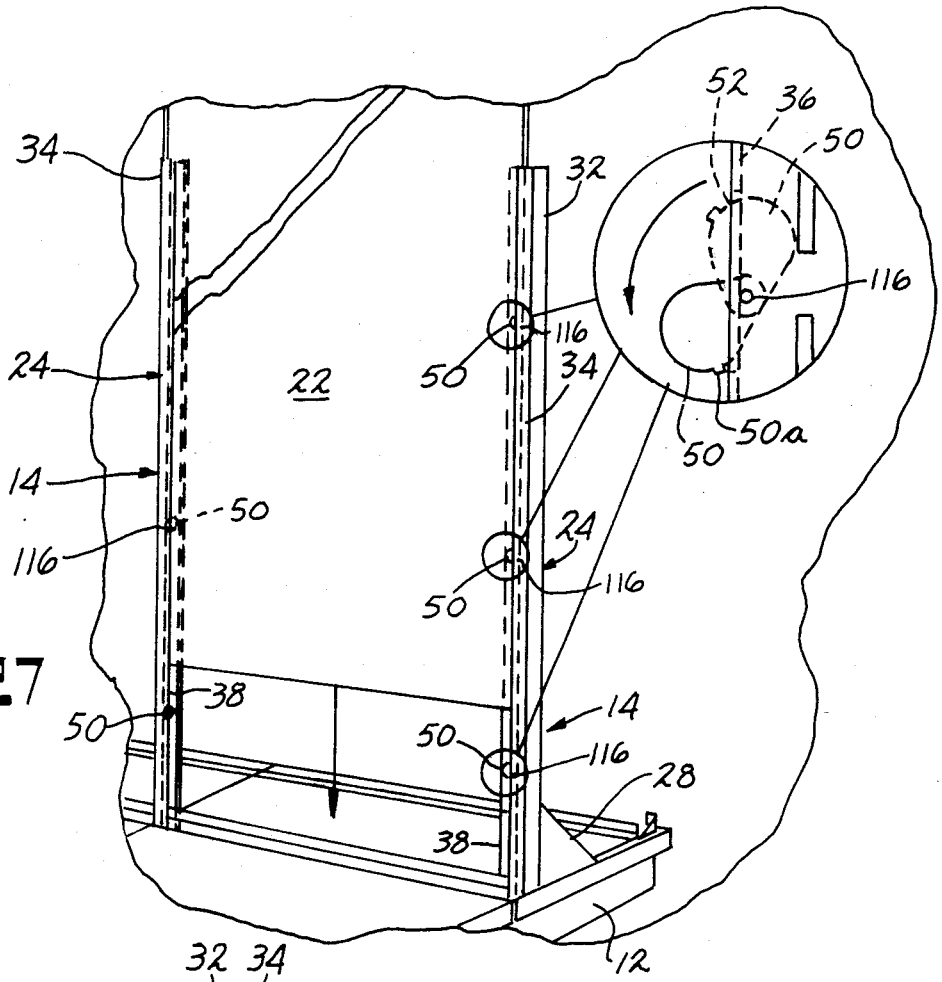
Figure 28:
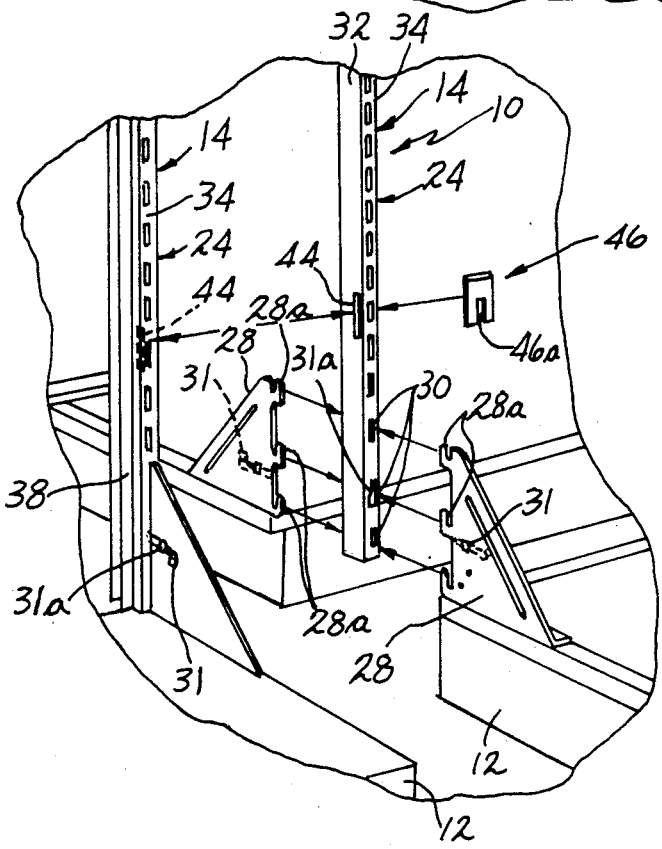
Figure 29:
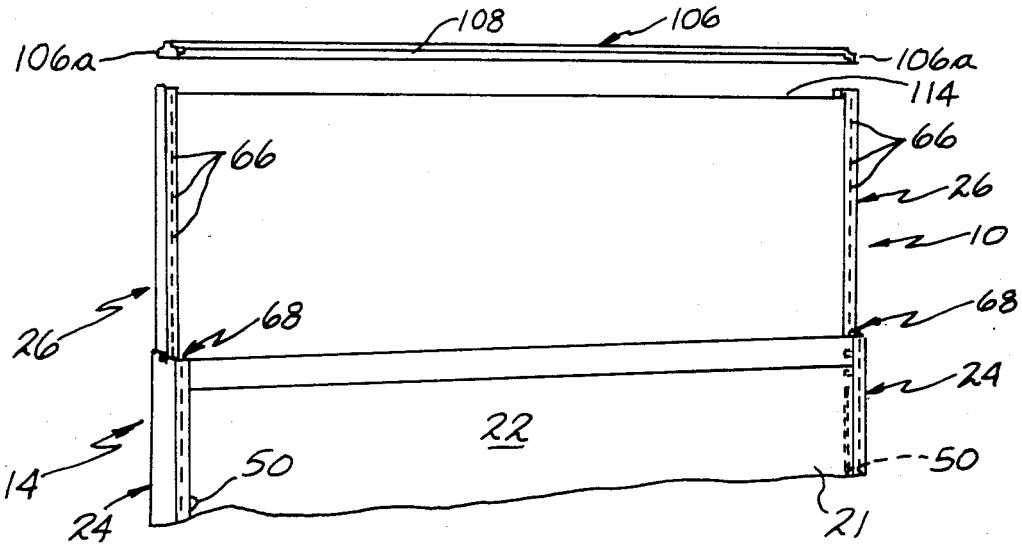
Figure 30:
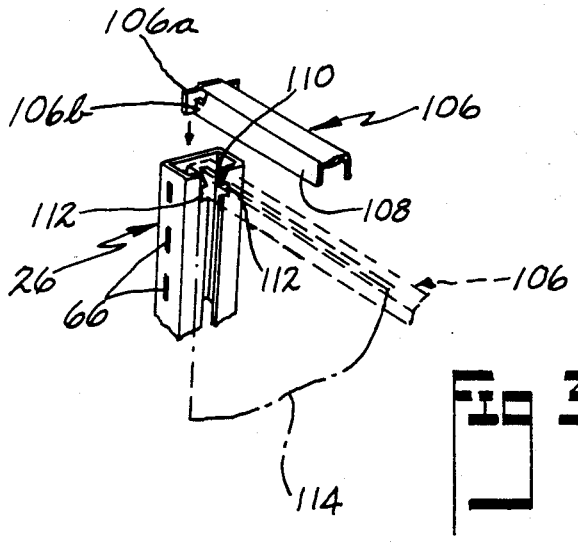

FIG. *7a* is a fragmentary, vertical sectional view of the FIG. 7 latch device having been automatically deactivated by upward movement of the extendible section, thus permitting upward adjustment thereof, but being operable to automatically reactivate itself to hold the extendible section in a newly extended position upon termination of the upward movement of the extendible section;

FIG. 8 is an enlarged rear elevational view of the holder of the gravity latch unit;

FIG. 9 is a side elevational view of the holder clip port in FIG. 8;

FIG. 10 is a top plan view of the holder clip portion illustrated in FIG. 8 taken generally along the plane of line 10—10 of FIG. 8 looking in the direction of the arrows;

FIG. 11 is an enlarged side elevational view of the locking clip portion of the gravity latch unit of FIGS. 1–7;

FIG. 12 is a rear elevational view of the locking clip portion illustrated in FIG. 11 taken generally along the plane of line 12—12 of FIG. 11 looking in the direction of the arrows;

FIG. 13 is a top plan view of the locking clip portion of FIGS. 11 and 12;

FIG. 14 is a front elevational view of a merchandise display unit which embodies the extensible and retractable standard construction of the invention;

FIG. 15 is a rear elevational view of a spacer clip member (i.e. back clip) which may be used in conjunction with the two-piece gravity latching unit of FIGS. 1–7 on the opposite side of the extendible section of the standard, for guiding the telescopic movement thereof;

FIG. 16 is a side elevational view of the spacer clip of FIG. 15;

FIG. 17 is a bottom plan view of the spacer clip of FIGS. 15 and 16 taken generally along the plane of line 17—17 of FIG. 15 looking in the direction of the arrows;

FIG. 18 is a broken, inner side elevational view of an extensible section of a standard of somewhat modified form as compared to that illustrated in FIG. 6, and one which embodies unique guide means for aiding in stabilizing the extensible section of the standard relative to the primary section of the standard, as well as stop means for limiting the withdrawal movement of the extensible section relative to the primary standard section;

FIG. 19 is a broken, side elevational view of the FIG. 18 section taken from the left hand side thereof;

FIG. 20 is an end plan view of the FIG. 18 section taken from the lower end thereof;

FIG. 21 is an end view of the FIG. 18 section taken from the top end thereof:

FIG. 22 is a broken, inner side elevational view of the primary section, of the standard, for use with the extendible standard section illustrated in FIGS. 18–21;

FIG. 23 is a broken side elevational view the primary standard section illustrated in FIG. 22, taken from the right hand side thereof;

FIG. 24 is an end elevational view of the standard section illustrated in FIG. 22 taken from the upper end thereof;

FIGS. 25 and 26 are enlarged views illustrating a U-clip adapted for use with side-by-side standards of the type illustrated for instance in FIGS. 22–24 for interlocking the same together when utilizing a plurality of the display fixtures embodying the invention and disposed in side-by-side relationship;

FIG. 27 is a generally perspective illustration of a display fixture base and back embodying the extensible and retractable standard structure of the invention, and illustrating with a detail enlargement the pivotal tab means utilized on the primary sections of the standards for retaining a back panel in coacting relationship with spaced upright standards forming the back structure of the display fixture;

FIG. 28 is a fragmentary, perspective view illustrating the mounting of a primary section of a standard onto a base portion of the fixture, in cantilevered relationship, in the assembly of the standard with the base, to form a display fixture; the aforementioned U-clip of FIGS. 25 and 26 is illustrated in exploded drawing form;

FIG. 29 is an exploded fragmentary view illustrating the assemby of a cross piece to the upper ends of the extendible sections of the standard, for connecting the latter together; and FIG. 30 is an enlarged fragmentary view illustrating the structure of the ends of the top cross piece of FIG. 29 for snap fastening coupling to the spaced extendible standard sections.

DESCRIPTION OF PREFERRED EMBODIMENT

The specific display fixture or cabinet illustrated in the drawings, as for instance in FIG. 14, is a fixture adapted for merchandising greeting cards, and gift wrapping such as for instance ribbons and bows and the like, but it will be understood that the fixture of the invention is not limited to such specific merchandise, but is adapted for use with other types and kinds of merchandise. The back of the fixture is adapted to be extended or retracted to increase or decrease the amount of space available for hanging merchandise or for different available environmental height situations in which the fixture is adapted for use to display merchandise.

The merchandising fixture or cabinet is designated by the reference number 10 and may conventionally include a base 12 (FIGS. 14, 27 and 28) and spaced standards 14 (FIGS. 6, 27 and 29) which are adapted to provide the back for the fixture or cabinet. The standards 14 are of the extensible and retractable type so that the back (in the embodiment illustrated) of the fixture can be selectively varied in height, thereby providing for the display of greater amounts or lesser amounts of merchandise on the fixture and for readily adapting the fixture to different environmental height situations. Merchandise may be conventionally displayed for instance by utilizing peg board between the extendible standard sections, as a back panel, and having hangers mounted on the peg board and supporting thereon various types of merchandise, such as for instance gift wrap bows, ribbon, prepackaged items, and the like.

The deck 61 (FIG. 14) of the fixture 10 in the embodiment illustrated may be a molded affair and is adapted to provide a series of stepped receptacles or cubicles 18 which are adapted for holding various items of merchandise. Side panels 19 may be provided for closing in the sides of the cabinet or fixture, with the deck extending between the front wall or panel 20 extending upwardly from the base 12 of the fixture and the back wall 21 of the fixture, as defined by the aforementioned uprights 14 and an associated lower back wall panel 22 (FIGS. 6 and 29) and as will be hereinafter described in greater detail.

The standards 14 comprise a primary section 24 and an extensible section 26 (FIGS. 6, 14 and 29) with section 26 being adapted for telescopic mounting relative to primary section 24, so that the height of the standards can be selectively varied, to change the height of the back of the merchandise fixture or cabinet. The primary standard sections are, in the embodiment illustrated, adapted to be mounted in generally cantilevered fashion on base 12 of the fixture, and as shown for instance in FIG. 28, wherein base 12 may be provided with rear brackets 28 secured thereon having hook portions **28*a* adapted to be received through aligned openings 30 in the lower end of the primary standard section of the standard. Upon downward movement of the primary section of each standard, it is supported as aforementioned in cantilevered condition on the bracket, to thus support the standard on the base. A manually actuatable, sliding lock bar 31, receivable, when moved forwardly, into locking coaction with a confronting complementary opening 31*a*** in the respective standard, may lock the standard to the base.

The extendible section 26 of the respective standard is received in telescopic relationship interiorly of the primary standard 24, and adapted for upward and downward movement relative thereto, to selectively vary the height of the standard.

Referring now in particular to FIGS. 18–24 which illustrate in detail preferred forms of the primary and the extendible standard sections, the primary standard section 24 in top end plan is of generally C-shaped configuration, as can be best seen in FIG. 24, and comprises an outer side wall 32, front and rear side walls 34, and inner side wall sections 36. Projecting laterally of each inner side wall section 36 is a web member 38 which may be interrupted at its upper end, as at **38*a*, but which is substantially continuous for the major portion of the height of the primary section 24, as seen in FIG. 22 and 23**.

The upper end of the primary section of each standard is notched as at 40, for a purpose to be hereinafter described, and the outer side wall 32 is preferably provided on the interior thereof approximately two-thirds of the distance down from the top thereof, with a stop tab 42 which is adapted to limit the inward telescopic movement of the associated extendible section 26 of the standard relative to the primary section, and as will be hereinafter described in greater detail. Each side wall 34 may be provided with a series of vertically spaced slots 43 offset to one side of the vertical center plane of the primary section 24 in a direction toward outer side wall 32. Slots 43 are adapted for mounting merchandise supports or other hooked connectors on the standard.

The lower end of the outer side wall 32 of the primary section 24 may be provided with elongated slot 44 which is adapted for use with a spring U-clip 46 (FIGS. 25, 26 and 28) for releasably securing two of the standards in side-to-side relationship when two of the merchandising display fixtures are disposed side-by-side, to increase the size of the display cabinet. It will be seen that the clip 46 is adapted to be received in the generally aligned slots 44 in the side-to-side adjacent condition of a pair of the primary sections, and then the clip is moved or forced downwardly to receive the side walls 32 of the primary sections in the bifurcated section **46*a*** of the clip, thus releasably locking the abutting standards together.

Each primary standard section adjacent its upper end is preferably provided with vertically spaced hook portions 48 coplanar with the respective underlying web 38, and which are adapted to receive therebetween in supported secured relation a cross member 49 (FIG. 29) having complementary hook structure or the like, on the ends thereof for readily mounting the cross member 49 on the primary sections of the standard. Cross member 49 can be assembled with the primary sections with vertically downward movement, after assembly of back panel 22 with the primary sections 24, as will be hereinafter described in greater detail.

Pivotal tab members 50 (FIGS. 22, 23, 27 and 29) are provided, pivoted to the respective side wall 34 of the primary section of the standard, for movement inwardly and outwardly through an associated slot 52 in respective wall section 36, for a purpose to be hereinafter described. Each of the tabs 50 may include a projection **50*a* thereon for facilitating the gripping of the tab by a workman, to pivot it into an operative position. In the position illustrated in FIGS. 22 and 23, the tabs are in inoperative position. In the full line position of the tab 50 illustrated in FIG. 27, the tab 50** is shown in outwardly pivoted operative position.

The extendible section 26 of the respective standard comprises an elongated member preferably of the type illustrated in detail in for instance FIGS. 18 through 21. Section 26 possesses a generally C-shaped configuration in top end plan, as illustrated in FIG. 21, and comprises an outer side wall 54, front and rear side walls 56, and inner side wall sections 58, to define the aforementioned C-shaped configuration.

The lower end of the extension section comprises a tail portion 60 (FIG. 18), which includes a portion 61 which in transverse cross section is of generally U-shaped configuration, having outwardly extending flanges 60*a* thereon, which are adapted to slidingly engage with the confronting interior surfaces of the inner side wall sections 36 of the primary section 24 of the standard, for guiding the telescopic movement of the extendible section 26 relative to the primary section 24 during the varying of the height of the standard. Flanges 60*a* are also adapted to abut with latch structure mounted on the upper end of the respective primary section 24, as will be hereinafter described, to limit the maximum upward movement of the extendible section 26 relative to the primary section 24.

Below U-shaped section 61 of the tail portion 60 there is preferably provided a transversely extending web 62, which extends laterally out beyond the extremities of the flanges 60*a* (FIG. 18) and which is adapted to slidingly guide the lower end of the extension section 26 of the standard relative to the primary section 24 of the standard, during telescopic movement of the extension section relative to the primary section. Web 62 is adapted to possess a slip fit with the interior width of the primary section of the standard, and thus stabilizes the extension section widthwise during its lengthwise adjusting movement.

A stop abutment 64 may be provided on the interior surface of outer side wall 54 in tail section 60, for limiting the downward movement of an associated back panel extending transversely between the extendible standards and forming the back of the fixture, and as will be hereinafter described in greater detail. In the embodiment illustrated, abutment stop tab 64 is formed from a partially severed portion of the outer side wall 54, and bent inwardly to form an abutment extending generally perpendicular to the plane of the wall 54.

In accordance with the invention, the extendible section 26 of each standard is provided on at least one side wall 56 thereof (and preferably on both side walls 56 thereof) with a plurality of vertically spaced slots or openings 66, which are adapted for coaction with a gravity actuated latch unit 68 (FIGS. 1 through 5 and FIGS. 7 through 13) for holding the extension section 26 in selected extended position relative to the primary section 24 of the standard, and as will be hereinafter described in detail. In the embodiment of extension section illustrated, the series of slots 66 provided on both side walls 56 of the extension section, are elongated in the lengthwise direction of the extension section 26, and are offset to one side of the vertical center plane of section 26 in the direction of the outer side wall 54, as shown in FIG. 19.

The gravity latch unit 68 comprises a holder clip portion 70 and a movable locking clip portion 72. Latch unit 68 may be formed of any suitable material, but may be conveniently formed of molded plastic. The holder clip portion 70 is adapted to be received snugly interiorly of the primary section 24 of the standard at the upper end thereof, while the movable locking clip portion is adapted to coact with and be received generally loosely within the holder clip portion, and is urged by the holder clip portion in a direction toward the extension section 26 of the standard, for holding the extension section in selected telescoped position relative to the primary section.

The locking clip portion 72 has a projection 74 formed on the frontal surface 75 thereof, with the projection 74 being adapted to be freely received within a selected one of the slots 66 in the extension section of the standard, for holding the latter in selected telescoped position relative to the primary section of the standard. Projection 74 has a cam surface 74*a* on its underside which slopes diagonally upwardly toward the slotted confronting surface of the extension section 26, and has a generally horizontally oriented top support surface 74*b*, adapted for coacting with the upper end of the respective slot 66, and thus support the extendible section 26 on the primary section 24 of the standard.

The holder clip portion 70 comprises a body of elongated, generally rectangular, configuration in side elevation (FIGS. 1, 7 and 9) and has a lip 76 on the upper end thereof, adapted for abutment with the underlying upper end of the respective primary section, and also with the upper end of the locking clip portion 72, to limit the downward movement of the holder clip portion relative to the upper end of the primary section of the standard when it is mounted thereon, and to limit the downward movement of the locking clip portion relative to the holder clip portion.

The holder clip portion also includes an interior diagonally downwardly oriented camming surface 78 disposed in its upper portion and at an angle in the embodiment illustrated, of approximately 30° with respect to the vertical. Camming surface 78 has a elongated slot 80 formed therein running lengthwise of surface 78, and extending completely therethrough, with the slot being provided with a detent 82 adjacent its upper end, for a purpose to be hereinafter described.

The bottom portion of the frontal wall 83 of the holder clip portion 70 is bifurcated as at 84 to increase the flexibility thereof, and the side walls 84*a* each has a barb or projection 84*b* formed thereon adjacent the lower end of the respective side wall, so that when the holder clip portion is forced downwardly into the upper end of the primary section of the standard, the resiliency of the side walls permit the entry of the side walls and barbs through the upper end of the primary section until the barbs 84*b* register with the openings or apertures 86 in the primary section (FIGS. 4 and 5) whereupon the projections or barbs snap into such apertures 86, and lock the holder clip portion to the upper end of the primary section of the standard. The holder clip portions can be released from the associated primary section of the standard by pushing inwardly on barbs 84*b* with an instrument so as to clear opening 86, thereby permitting the holder clip portion 70 to be pryed upwardly from the top end of the primary standard section 24.

The lip portion 76 on the upper end of the holder clip portion overlaps the upper edge of the primary section 24 as can be best seen in FIGS. 5 and 6, and is received in the aforementioned notched portion 40 of the primary section. Thus it will be seen that the holder clip portion 70 is retained or locked to the upper end of the primary section of the standard, while the locking clip portion 72 is movable relative to the holder clip portion and relative to the standard sections.

In the embodiment illustrated, the locking clip portion 72 is of generally V-shaped configuration in side elevation (FIGS. 2 and 11) and has a top lip 87 adapted for abutment with the upper end of the holder clip portion 70, to limit the downward movement of the locking clip portion relative to the holder clip portion.

The locking clip portion is also provided with a tail 88 (FIGS. 2, 3, 11 and 12) of generally T-shaped configuration in the embodiment illustrated, extending outwardly from the body portion 89 of clip portion 72, and is disposed in the embodiment illustrated, at an angle of approximately 124° with respect to the vertical plane of the frontal surface 75 on the body of clip portion 72. Obliquely oriented cam surface 90 on clip portion 72 is formed complementary to cam surface 78 on clip portion 70 for sliding engagement therewith.

Assembly of the locking clip portion 72 to the holder clip portion 70 is accomplished by inserting the tail 88 on clip portion 72 through the slot 80 in the holder clip portion with the locking clip portion 72 rotated 90° from its normal operative position, as shown for instance in FIG. 3. The tail has sufficient length that it can be inserted through the slot 80, and still permit rotation of the locking clip portion 72 relative to the holder clip portion 70 and forwardly of frontal surface 83 thereof, 90°, with the locking clip portion 72 then being received in guided relation within the recess 92 (FIGS. 1 and 3) defined by the holder clip portion 70, with aforementioned cam surface 90 on the locking clip portion received in surface-to-surface camming engagement with the diagonal camming surface 78 on the holder clip portion. The tail 88 retains the locking clip portion with the holder clip portion while gravity urges the movable locking clip portion downwardly with respect to the holder clip portion, thus urging the projection 74 toward and freely into one of the confronting slots 66 in the extendible section 26 of the standard.

In the lowermost position of locking portion 72 with respect to holder portion 70, as limited by the engagement of lip 87 on the locking portion with the top surface of lip 76 on the holder portion, the frontal surface 75 on the locking portion and the frontal surface 83 on the holder portion are generally coplanar and disposed immediately adjacent to the confronting side surface 56 on the extendible section 26 of the standard. Projection 74 extends forwardly of such frontal surfaces 75 and 83 in the "down" position of the locking portion, and thus is received in a confronting one of the slots in extendible section 26. The upper end of the confronting receiving slot is adapted to engage the top surface 74*b* of projection 74, to thus hold the extendible section 26 in selected position relative to the primary section 24 of the standard.

Figure 7A:
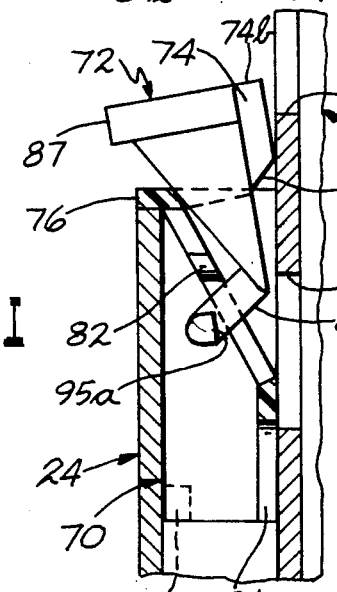

When it is desired to adjust the height of the standards, and thus the height of the display fixture, this is accomplishable by merely gripping the extendible section 26 of each standard and raising it. Upon upward movement of the extendible section, the bottom end of the projection receiving slot 66 engages the diagonal cam surface 74*a* on the projection, to cause upward and rearward movement of the locking clip portion 72 relative to the holder clip portion 70 as shown in FIG. 7*a*, with the cam surfaces 78 and 90 coacting with one another in sliding relation during movement of the projection 74 out of the receiving slot due to upward movement of the extendible section to selected position.

Release of the extendible section from upward movement will cause the projection 74 on the locking clip portion, the latter being actuated by gravity, to freely enter a confronting slot 66 in the extendible section 26, to once again support the extendible section on the top surface 74*b* of the locking clip portion 72, and thus maintain the extendible section in its adjusted position. Thus it will be understood that the two-piece latch unit 68 is automatically deactuated by merely lifting upwardly on the extendible section 26, and is automatically reactivated by termination of such upward movement of the extendible section, thus facilitating adjustment of the standards and thus the height of the display fixture.

The locking clip portion 72 may be totally deactivated so as to be maintained or held mechanically in an inactive position, by manual grasping of the locking clip portion 72 at its upper end and moving it upwardly and rearwardly, thereby causing the projection 74 to move back out of the receiving slot in the extendible section of the standard, and until the stem 94 of tail 88 passes the detent 82 in slot 80. The thickness of the tail stem 94 is such that it can pass the detent 82 only by slightly forcing it beyond the detent, and upon release of the locking clip portion it will be automatically retained in such elevated and rearwardly tipped position (FIGS. 4 and 5) relative to the holder clip portion by the aforementioned interferring engagement between the detent and the stem of the tail. Cross section 95 of tail 88 may be provided with forwardly facing flats 95*a* adapted for engagement with the back side of wall 78 of holder clip portion 70, as shown in FIG. 7*a* upon maximum upward motion of clip 72.

Thus the extendible section 26 can be positioned upwardly or downwardly with respect to the primary section of the standard to whatever extent desired while the latch unit 68 is maintained in positive deactuated condition. To reactivate the latching unit from such mechanically held deactuated position, a slight force may be applied to the top of the locking clip portion which causes the stem 94 of the tail to push past the detent 82, whereupon the locking clip portion once more automatically moves by gravity into latching condition with respect to the extendible section 26 of the standard. When the locking clip portion is raised to positive deactivated position, as shown for instance in FIG. 4, the locking projection 74 of the locking clip portion is disposed completely rearwardly of the plane of the frontal surface 83 of the holder clip portion 70, so as to be completely out of contacting relationship with respect to the confronting side of the extendible section of the standard, and as illustrated. The center of gravity of locking portion 72 is such that it will automatically maintain such rearwardly tipped position until a force is applied to the top of the locking portion.

As can be seen from FIGS. 4 and 13, the slots 66 in extendible section 26 are offset in the direction of outer side wall 54, and thus locking projection 74 is offset to one side of the vertical center plane X—X of the locking clip portion (FIG. 13) so as to register with the vertical series of slots 66, while the tail 88 of the locking clip portion is offset to the other side of plane X—X.

It will be seen as for instance from FIG. 4, that a latch unit of the invention may be utilized on both sides of the extendible section 26 of the standard so as to support the standard from both sides thereof, or only one latch unit may be utilized with each standard, with the other side of the standard receiving therein a spacer member 96 (FIGS. 5 and 15 through 17) with the spacer member providing for guiding of the extendible section 26 of the standard relative to the primary section 24.

Spacer member 96 comprises in the embodiment illustrated, a body portion of generally rectangular configuration in side elevation (FIG. 16) but with the frontal wall 98 of such body being bifurcated or recessed as at 100, to give greater flexibility to the lower ends of side walls 98*a*, each of which is preferably provided adjacent its lower end with a barb or detent 102 which is adapted to be received in the aforementioned openings 86 in the respective primary section 24 of the standard, for releasably locking the spacer clip 96 on the upper end of the primary section. The top of the spacer clip 96 is preferably provided with a lip portion 104 which overlaps the side walls 98*a*. Thus when spacer 98 is inserted into the open top end of the primary section 24 of the standard, it can be forced downwardly to be mounted on the open end of the standard until the lip portion 104 hits the confronting edges of the notched section 40 of the primary section of the standard, at which time the aforementioned barbs 102 are aligned with and snap into the confronting openings 86 in the standard, to releasably lock the spacer 96 to the standard.

When a pair of the latch units 68 are utilized on the upper end of the primary section of the standard, as shown for instance in FIG. 4, one of the latch units is designated as a left hand unit and the other is designated as a right hand unit with the left hand and right hand units being mirror images of one another. The reason for this is that the openings 66 in the extender section 26 of the standard are offset on both sides of the extender section, as aforementioned, to the same one side of the vertical center plane of the standard, and therefore require left and right hand mirror image units. All of the latch units illustrated in the drawings, except for those shown on the left hand side of the standards shown in FIGS. 4 and 6, are left hand latch units. The latch units are preferably molded from any suitable material such as, for instance, from plastic materials as aforementioned and may expeditiously be formed of nylon.

The upper ends of the extendible sections 26 of the telescopic standards may be capped as at 104 (FIG. 6) with a molded cap member to finish off the standard and provide a more pleasing appearance thereto.

As an alternative or supplemental arrangement, the telescopic standards may be provided with a cross member 106 (FIG. 29) which at its ends may include a cross web 106*a* (FIG. 30) and projecting tabs 106*b* on both sides of the cross piece on the side wall portions 108 thereof.

Cross piece 106 may be forced downwardly into snap fastened assembly with the upper ends of the extendible sections 26 of the spaced standards, as shown in dashed lines in FIG. 30, with the flexibility of tabs 106*b* coacting with upwardly divergent cam edges 110 (FIGS. 19 and 30) on the upper ends of the extender sections 26, providing for convenient receipt of the flexible tabs 106*b* in the notched areas 112 on extender sections 26.

A back panel 114 may be fitted vertically downwardly into the slotted space between inner side wall sections 58 of the spaced extendible sections 26, prior to installing cross piece 106. Panel 114 may be formed of for instance peg board, or may be a non-apertured panel and may be supported on its lower edge by aforementioned cross piece 49 (FIG. 29) extending between the upper ends of the primary sections, and which is adapted for supporting the deck 16 thereon at the rearward end of the deck. In the alternative back panel 114 could be supported on the aforementioned stop abutments 64 adjacent the lower end of each extendible section 26 of the spaced standards.

The aforementioned pivotal tabs 50 which may be pivoted as by means of fasteners or rivets 116 to the primary section of the standard, are adapted to be swung from the generally hidden position within the primary section as illustrated in FIG. 27 in phantom lines, to outwardly extending position as illustrated in full lines, so as to hold an associated back panel (e.g. FIGS. 6, 27 and 29) to the standards with the panel 22 being disposed between one of the laterally projecting flanges 38 on each pair of the uprights and the associated tabs. By rotating the tab from the extended position shown in the enlarged illustration in FIG. 26 to a retracted position, the panel is adapted to be removable from the back of the fixture. Tabs 50 are preferably provided on both sides of each primary section as shown in FIG. 22, so that back panels can be retained on either or both sides of the primary section between the respective web 38 and respective set of tabs 50.

It will be seen therefore from the foregoing that the installation of the standards on the base 12 and the extension of the standards to accommodate different environmental situations or requirements, and to vary the height of the merchandise fixture or cabinet, and the installation of the rear panel or panels in assembled relationship with the standards and the base of the fixture, can be expeditiously accommodated, without the need of any special fasteners or tools or the like and by utilizing relatively unskilled labor.

From the foregoing description and accompanying drawings, it will be seen that the invention provides a novel merchandise display fixture or unit which includes upright standard members comprising a primary section and an extendible section, telescopically mounted on the primary section, with the extendible section having a plurality of spaced apertures therein oriented lengthwise thereof, and with there being provided a two-piece gravity latch unit mounted on the primary standard section, and adapted when in operative position, for holding the extendible section in selected position relative to the primary section, and that the latch unit is so constructed and arranged that it can be readily deactivated to permit extension of the extendible section of the standard relative to the primary section of the standard by merely lifting up on the extendible section of the standard, and that upon release of the extendible section from upward movement, the latch unit will be automatically reactivated, to hold the extendible section of the standard in its newly extended position, thereby expeditiously accommodating the fixture to different height requirements.

The invention also provides a two-piece latch unit for a merchandise display fixture which is gravity actuated toward operative position, and which comprises a holder clip portion and a coacting locking clip portion, with the holder clip portion being adapted for mounting on the upper end of a primary section of a telescopic standard, and with a locking clip portion being mounted in the holder clip portion and having a projection thereon adapted to be freely received in a confronting one of a series of vertically spaced openings in the extension section of the standard, for holding the extendible section in its selected extended position. Means is also provided on the locking clip portion for effectively deactivating the locking clip portion by moving the latter to an upward position and providing for automatically holding it in such position so that it is completely deactivated from operation, to thereby permit free telescopic movement of the extendible section of the standard relative to the primary section of the standard, after which the locking clip portion can be readily reactivated by light manual pressure, for again automatically holding the extendible section in its selected extended position.

The invention also provides a telescopically extendible standard member for use in forming the back of a merchandise display fixture, with the standard being readily extendible to vary the height of the standard, and having stop means thereon for limiting the telescopic movement of the extendible section of the standard relative to the primary section of the standard, as well as guide means on the extendible section of the standard for expediting and stabilizing the telescopic movement of the extendible section relative to the primary section.

The terms and expressions which have been used are used as terms of description, and not if limitation, and there is no intention in the use of such terms and expressions of excluding any equivalents of any of the features shown or described, or portions thereof, and it is recognized that various modifications are possible within the scope of the invention claimed.

We claim:

1. In a merchandise display fixture comprising a substantially upright primary standard, an extension standard telescopically mounted on the first mentioned standard and having a plurality of spaced apertures therein lengthwise thereof, a pair of gravity latch units mounted on said first mentioned standard on opposite sides of said extension standard, each of said latch units having a latch projection thereon adapted for automatic coaction with a selected one of a confronting series of said apertures, for holding said extension standard from both sides thereof in selected position relative to said first mentioned standard, and means for automatically causing deactivation of said latch units to permit extension of said extension standard relative to said first mentioned standard by lifting upwardly on said extension standard, and upon release of said extension standard from upward movement causing automatic reactivation of said latch unit and receipt of said projection into a confronting one of said apertures, to thus automatically hold said extension standard in newly extended position relative to said first mentioned standard.

2. In a merchandise display fixture comprising a substantially upright primary standard, and extension standard telescopically mounted on the first mentioned standard and having a plurality of spaced apertures therein lengthwise thereof, a gravity latch unit mounted on said first mentioned standard and having a latch projection thereon adapted for automatic coaction with a selected one of said apertures, for holding said extension standard in selected position relative to said first mentioned standard, and means for automatically causing deactivation of said latch unit to permit extension of said extension standard relative to said first mentioned standard by lifting upwardly on said extension standard, and upon release of said extension standard from upward movement causing automatic reactivation of said latch unit to thus hold said extension standard in newly extended position relative to said first mentioned standard, and wherein said latch unit comprises a holder clip portion adapted to be received interiorly of said first mentioned standard at the upper end thereof, and a movable locking clip portion coacting with said holder clip portion and being urged by the latter in a direction towards said extension standard, said locking clip portion having said latch projection thereon adapted to be freely received within a selected one of said apertures in said extension standard, for supporting said extension standard in selected extended position relative to said first mentioned standard, said latch projection having a cam surface thereon comprising said means, adapted for engagement with the lower edge of the respective extension standard opening upon lifting of said extension standard relative to said first mentioned standard, to cause upward and rearward movement of said locking clip portion relative to said holder clip porton, permitting said extension standard to slide past said locking clip portion to an elevated adjusted position relative to said first mentioned standard, release of said extension standard permitting said latch projection to automatically enter a confronting one of said openings in said extension standard and to coact with the upper defining edge of said one opening so as to hold said extension standard in its newly extended position relative to said first mentioned standard.

3. A display fixture in accordance with claim 2 wherein said holder clip portion comprises a sloping diagonally arranged surface thereon and said locking clip portion comprises a complementary diagonally arranged surface thereon adapted for sliding coaction with said holder clip portion surface so as to generally continually urge said locking clip portion and associated latch projection in the direction of said extension standard, said locking clip portion and associated latch projection being movable upwardly and rearwardly relative to said holder clip portion in response to upward movement of said extension standard so as to permit said latch projection on said locking clip portion to move outwardly of the confronting plane of said extension standard.

4. A display fixture in accordance with claim 2 wherein said locking clip portion includes a laterally projecting tail section thereon received through a slotted opening in said holder clip portion for movably attaching said clip portions together, said locking clip portion being rotatable relative to said holder clip portion so as to permit detachment of said tail from its receiving slotted opening and intentional separation of said locking and holder clip portions, when the latter are disassembled from said standards.

5. A display fixture in accordance with claim 4 wherein said slotted opening includes means for mounting said locking clip portion in an upwardly and rearwardly raised position relative to said holder clip portion, to thus deactivate said locking clip portion and maintain it in deactivated position against gravitational force.

6. A display fixture in accordance with claim 2 including means on said holder clip portion adapted for snap-fastening receipt in openings in said first mentioned standard to detachably interlock the holder clip portion to said standard, said holder clip portion having an upper lip adapted to rest on the upper end of said first mentioned standard for supporting and positioning said holder clip portion on said first mentioned standard.

7. A display fixture in accordance with claim 1 wherein said first mentioned standard comprises an elongated member including an outer end wall, spaced side walls, and spaced inner end wall sections extending inwardly toward one another from the respective side wall, and defining a generally C-shape configuration in top plan, said latch projection being offset laterally of the vertical center plane of said latch units in the direction of said outer end wall and in alignment with said apertures in said extension standard which are likewise offset laterally from the vertical center plane of said extension standard.

8. A display fixture in accordance with claim 2 wherein said holder clip portion has a lip on its upper end and said locking clip portion has a complementary lip on its upper end, said lips being adapted for engagement with one another to limit the downward movement of said locking clip portion with respect to said holder clip portion.

9. A display fixture in accordance with claim 8 wherein said holder clip and said locking clip portions each include a generally vertical planar frontal surface, the frontal surface of said locking clip portion and the frontal surface of said holder clip portion being generally coplanar in the lowermost position of said locking clip portion relative to said holder clip portion, with said lips on said clip portions being engaged with one another, said latch projection extending outwardly of said plane and said frontal surfaces.

10. A display fixture in accordance with claim 1 including stop means on said primary standard above the lower end thereof for limiting the inward telescoping movement of said extension standard relative to said primary standard.

11. A display fixture in accordance with claim 2 including a back clip unit mounted on said first mentioned standard in spaced opposed relationship to said gravity latch unit and being operative to guide the telescopic movement of said extension standard relative to said first mentioned standard.

12. A display fixture in accordance with claim 11 wherein said back clip includes means thereon adapted for snap-fastening receipt in openings in said first mentioned standard, to detachably interlock said back clip unit to said first mentioned standard.

13. A display fixture in accordance with claim 12 wherein said back clip unit includes an upper lip portion adapted to engage the upper end of said first mentioned standard for supporting and positioning said back clip unit on said first mentioned standard, said back clip unit including a generally vertical planar frontal surface providing a guide for the confronting side of said extension standard during telescopic movement of said extension standard relative to said first mentioned standard.

14. A display fixture in accordance with claim 1 wherein said primary standard is of generally C-shaped configuration in horizontal cross section, and has a plurality of vertically spaced apertures in at least one side thereof, and adapted for use in mounting said primary standard on a base, said primary standard having spaced webs projecting laterally outwardly from the arms of said C configuration in inwardly spaced relationship to the distal ends of said arms, and tab means pivoted to a side of said C-shaped configuration on said primary standard and adapted to form a releasable retainer for a panel of backing material supported by said primary standard between one of said webs and associated tab means, said tab means being pivotable from an inactive position wherein said panel backing material on said fixture can be removed from the fixture, to an active position wherein said tab means prevent lateral outward removal of the backing panel from the standard.

15. A display fixture in accordance with claim 1 wherein said extension standard comprises an elongated member of generally C-shape configuration in horizontal section and is telescopically received within said primary standard for sliding movement with respect thereto, and stop means on said primary standard adapted for engagement with the lower end of said extension standard to limit the telescoping movement of said extension standard into said primary standard.

16. A display fixture in accordance with claim 1 wherein said extension standard is telescopically received for lengthwise movement within and with respect to said primary standard, and web like stop means adjacent the lower end of said extension standard adapted for engagement with the lower end of said gravity latch units, for preventing withdrawal of said extension standard completely from said primary standard unless said latch units are is first removed from their mounted position on said primary standard.

17. A display fixture in accordance with claim 1 wherein said extension standard includes a tail portion on its lower end thereof which includes a section of a width received in generally close fitting but movable relationship in said primary standard, the remainder of said extension standard being of lesser width as compared to the receiving width of said primary standard and being freely slidable in said primary standard, said tail portion section preventing undesired, side-to-side movement of the lower portion of said extension standard relative to said primary standard during extension of said extension standard relative to said primary standard.

18. A display fixture in accordance with claim 1 wherein said extension standard comprises an elongated member of generally C-shape configuration in top plan and is telescopically received within said primary standard, and has a tail section on the lower end thereof, said tail section comprising a lower transversely extending web which is adapted to slidingly engage in generally close fitting relationship with the interior confronting surfaces of said primary standard, said tail section above said web comprising a generally U-shaped portion having outwardly extending flanges on the outer ends of the U arms, said flanges providing surfaces adapted for sliding, guiding engagement with the interior confronting surfaces of said primary standard during telescopic sliding movement of said extension standard relative to said primary standard, said tail section including stop means adapted for limiting the withdrawal of said extension standard from telescoped relationship with said primary standard.

19. A display fixture in accordance with claim 18 wherein said stop means is provided by the upper ends of said flanges which are adapted to engage the lower end of said latch means.

20. A display fixture in accordance with claim 13 wherein said primary standard and said extension standard are each formed of 16 gage steel.

21. A display fixture in accordance with claim 18 wherein said primary standard includes stop means for limiting inward telescopic movement of said extension standard relative to said primary standard, said stop means comprising a tab formed from a partially severed section of said primary standard and bent into the plane of movement of said extension standard, and adapted for abutment with the lower end of said tail section to limit inward telescoping movement of said extension standard.

22. A display fixture in accordance with claim 1 wherein said primary standard is notched at its upper end for receiving in generally snug relation in said notched section the respective of said gravity latch units, whereby said primary standard when assembled with said gravity latch units possess a generally horizontal top surface adjacent to which extends said extension standard.

23. A gravity latch unit adapted for assembly with a primary standard of a merchandise display fixture and adapted for coaction with an apertured extension standard telescopically mounted on the primary standard, for holding the extension standard in a selected position relative to the primary standard, said latch unit comprising a holder clip portion adapted to be received interiorly of the upright standard at the upper end thereof and in attached relation thereto, and a movable locking clip portion coacting with and received within said holder clip portion, and being urged by said holder clip portion in a direction toward the extension standard, said locking clip portion having a latch projection extending laterally with respect to the frontal surface of said holder portion for being received within one of the apertures in the extension standard, for supporting the extension standard in selected extended position relative to the primary standard, said locking clip portion including means providing for automatic deactivation of said latch unit to permit extension of the extension standard relative to the primary standard responsive to lifting of the extension standard relative to the primary standard, and upon release of the extension standard from upward movement, said locking clip portion automatically moving by gravity into holding coaction with the extension standard for supporting the latter in newly extended position relative to the primary standard.

24. A latch unit in accordance with claim 23 wherein said holder clip portion and said locking clip portion are formed of plastic material.

25. A back clip member adapted for use with a substantially upright primary standard and an extension standard telescopically mounted on the first mentioned standard in a merchandise display fixture, with the primary standard being open at its upper end and being adapted to receive interiorly thereof the back clip member adjacent the extension standard for aiding in guiding the telescopic movement of the extension standard relative to the primary standard, said back clip member comprising a body portion having a generally vertically oriented frontal guiding surface and having a lip portion at the upper end of said body portion projecting laterally of said body portion except at said frontal guiding surface, and means on the lower section of said body portion adapted for coaction with the primary standard for detachably locking said back clip member in mounted position on said primary standard, the last mentioned means comprising lateral projections on opposite sides of said body portion adapted to be received in complementary openings in the primary standard.

26. A latch unit in accordance with claim 23 wherein said locking clip portion comprises a generally V-shaped in side elevation, body portion having a lip on the upper end thereof adapted for abutment with the upper end of said holder clip portion, to limit the downward movement of the locking clip portion relative to the holder clip portion, and said locking clip portion including a tail comprising a laterally projecting stud of generally T-shaped configuration, extending outwardly from said body portion, said frontal surface on said body portion being disposed in a substantially vertical plane with said tail projecting from the plane of said frontal surface at an angle of approximately 124°.

27. A latch unit in accordance with claim 23 wherein said holder clip portion comprises a body section of elongated generally rectangular configuration in side elevation and including an interior diagonally oriented camming surface thereon commencing at the upper end thereof disposed at an angle of approximately 30° with respect to the plane of the frontal surface of said holder clip portion, said camming surface having an elongated slot formed therein extending completely through said holder clip portion, and detent means formed adjacent said slot and extending into the space thereof, adapted for holding coaction with a tail on the locking clip portion of the latch unit, to selectively hold said locking clip portion in deactivated position with respect to said holder clip portion, said tail including a cross bar section having spaced generally flattened abutment surfaces thereon adapted for guiding coaction with confronting surfaces on said holder clip portion, the last mentioned surfaces being disposed in a plane extending generally parallel to the plane of said camming surface.

28. A standard adapted for use in upright position in a merchandise display fixture, for forming the structural framework of the display fixture, said standard comprising an elongated member comprised of an outer end wall, side walls, and spaced inner end wall sections extending inwardly toward one another from the respective side wall, and defining a generally C-shape configuration in top plan, and having generally laterally projecting spaced webs extending outwardly from said inner end wall sections, and a stop tab formed on said outer end wall of said member above the lowermost end of the latter adapted for limiting inward telescoping movement of an associated extension section of the standard, with respect to said member.

29. An extension standard section adapted for being received in telescoped relationship in an upright primary standard section of a merchandise display fixture, for forming the framework of the fixture, said extension standard section comprising an elongated member comprised of an outer end wall, side walls, and spaced inner end wall sections extending inwardly toward one another from the respective side wall, and being of generally C-shaped configuration in top plan having a series of lengthwise spaced generally aligned openings formed in at least one of said side walls thereof, said series of openings being offset laterally of the vertical center plane of said one side wall in the direction of said outer end wall, said extension standard section having a tail portion on the lower end thereof, with said tail portion including a web extending transversely of said extension standard section, and of a size dimensioned to fit in slip-fit relation within the interior confines of the associated primary standard section, so as to accurately guide telescopic movement of the extension standard section relative to the primary standard section, said web being adapted for engagement with an abutment near the upper end of the primary standard section for use in preventing complete withdrawal of the extension standard section from the primary standard section.

* * * * *